United States Patent [19]

Lee

[11] 4,014,058

[45] Mar. 29, 1977

[54] FEEDING DEVICE FOR HIGH SPEED NUT FORMERS

[76] Inventor: Yuan Ho Lee, 85 Jen Ho Road, Tainan, China /Taiwan

[22] Filed: Dec. 29, 1975

[21] Appl. No.: 644,942

[52] U.S. Cl. ..... 10/76 T

[51] Int. Cl.[2] ..... B21D 53/24

[58] Field of Search ..... 10/11 T, 12 T, 72 T, 10/76 T, 162, 166, 172

[56] References Cited

UNITED STATES PATENTS

| | | | |
|---|---|---|---|
| 729,822 | 6/1903 | Wetmore | 10/72 T |
| 1,899,221 | 2/1933 | Ward et al. | 10/72 T |
| 2,058,698 | 10/1936 | Lehman | 10/12 T |
| 2,288,643 | 7/1942 | Purtell | 10/11 T |
| 3,274,626 | 9/1966 | Van de Meerendonk | 10/76 T |
| 3,533,115 | 10/1970 | Van de Meerendonk | 10/76 T |
| 3,604,242 | 9/1971 | Allebach et al. | 10/12 T |

*Primary Examiner*—C.W. Lanham
*Assistant Examiner*—E. M. Combs
*Attorney, Agent, or Firm*—Lane, Aitken, Dunner & Ziems

[57] ABSTRACT

A feeding device for a high speed nut former machine is disclosed having a mechanism mounted on the machine and attached to a feeding plate capable of advancing in a linear fashion and returning in a motion in which the feeding plate is removed from a guide path. The feeding plate has a plurality of indentations of a configuration suitable for holding and conveying the nut blanks being formed along the guide path defined by guide plates between successive nut blank forming dies due to the motion of the mechanism attached to the feeding plate by causing the indentations to mesh with the blanks and to convey the blanks forward in a linear fashion, to next leave the feeding path, and to then return to the original position. In this manner, nut blanks are successively fed in an intermittent fashion from one die to the next in a plurality of steps.

4 Claims, 4 Drawing Figures

FEEDING DEVICE FOR HIGH SPEED NUT FORMERS

BACKGROUND OF THE INVENTION

Conventional nut formers have machine bodies having a plurality of dies arranged in sequence thereon, and opposite the dies, a ram having a plurality of punches equal in number to the number of dies and arranged to carry the punches so that when the ram advances, each punch will act upon the nut blanks in the corresponding die to produce a formed nut blank. The feeding and transferring device for the nut blanks generally comprise clamping mechanisms provided on the lower end of a rod having its axis perpendicular to a line drawn between the center points of two adjacent dies. After clamping the workpiece, the rod makes a turn of 180°, thereby turning the clamping arm and causing the workpieces to be transferred to the next adjacent dies in preparation for the next punching operation. This operation requires a feeding device of a very complicated construction. Further, such a feeding device must wait until the ram has retracted before it can begin the transfer operation. Moreover, the clamping arm is provided at a right angle to the lower end of the perpendicular shaft and must make a left to right turn of 180° making the distance of travel between two dies relatively long. The complex mechanical movements are easily affected by inertia effects and are sometimes unstable, thereby preventing high speed operation.

SUMMARY OF THE INVENTION

The present invention provides an improved feeding device of simple construction which does not require making a turn of 180° but instead makes only a straight forward motion between two dies. A mechanism is provided capable of moving a feeding plate in a linear fashion along a guide path defined by parallel guide plates between successive dies and then removing the feeding plate from the guide path to return it. The feeding plate has plural indentations adapted to engage, hold, and convey nut blanks along the guide path in a plurality of steps between successive dies.

BRIEF DESCRIPTION OF THE DRAWINGS

In order to explain more clearly the principle of operation, the effectiveness and special features of the present invention, the invention will now be described with reference to the appended drawings wherein.

DESCRIPTION OF THE PREFERRED EMBODIMENTS

Figure 1:
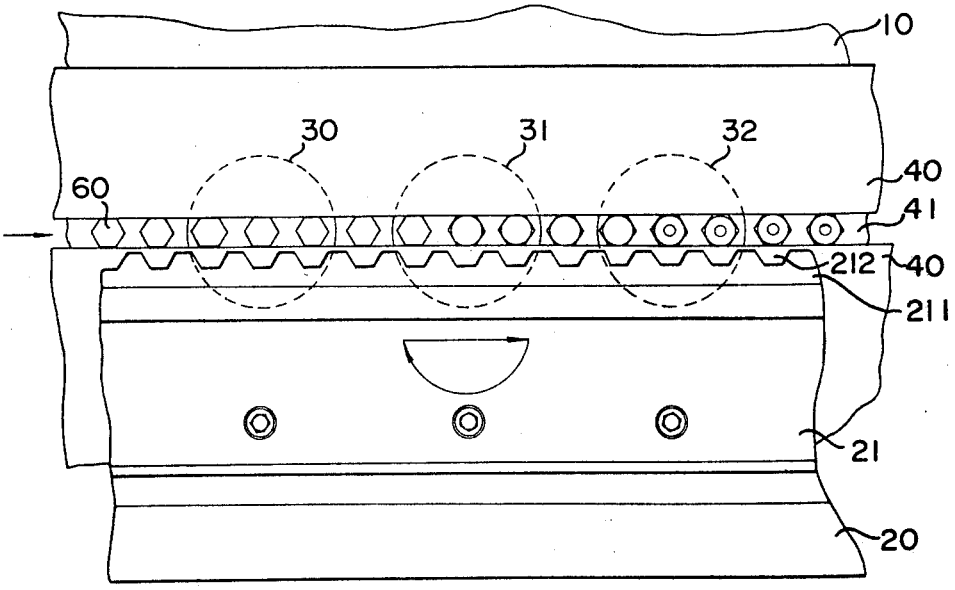
FIG. 1 is a partial perspective view of a feeding device according to the present invention.
Figure 2:
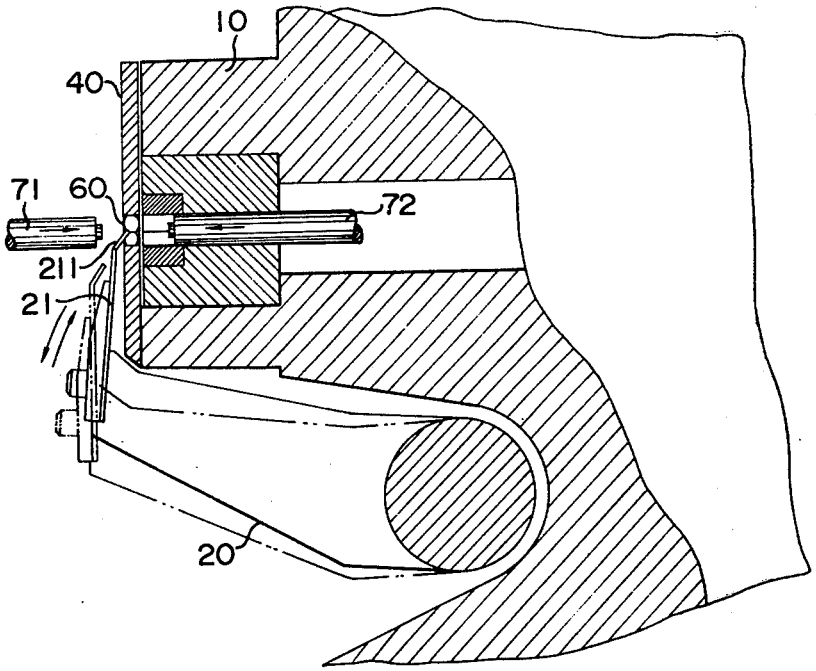
FIG. 2 is a partial cross section of a feeding device according to the present invention.

As shown in FIGS. 1 and 2, the present invention comprises a nut former machine body 10 having a manipulating mechanism 20 provided thereon. The mechanism 20 advances in a linear fashion and returns in a downwardly arching motion. Dies 30, 31, 32 are provided equidistant from each other and are aligned with punches on a ram (not shown) for forming nut blanks. Two guide plates 40—40 are provided on machine body 10 to define a linear feed path 41 coaxial to a line through the centers of the dies. Nut blank workpieces are conveyed along the feed or guide path 41 to the front of and past the centers of dies 30, 31, 32 in a linear fashion in a plurality of discrete steps. Spring plates (not shown) may also be provided on guide plates 40—40 to insure that the workpieces are held in the proper position during forming operations.

A feeding plate 21 is mounted by means of machine screws on the upper portion of manipulating mechanism 20. The upper edge 211 of the feeding plate 20 curves inwardly towards the machine body 10 and is provided with indentations 212—212 in the shape of one half of the external shape of the formed product and divides the distance between two dies into several equal parts. According to the present embodiment, the distance between two dies is divided into four equal distances, the distances being defined by the center to center distance of the indentations 212—212.

According to the present embodiment, after a workpiece 60 is cut by a cutting die (not shown), it is transferred to the feeding path 41. When the feeding plate 21 is lowered by means of the manipulating mechanism 20 the indentations 212—212 will mesh with the workpiece 60 and transfer it in a linear fashion to the position of the next adjacent workpiece which has been simultaneously advanced an equal distance. After the predetermined distance is reached the manipulating mechanism will stop and cause the feeding plate to leave the feeding path and return to the original position thereof along an arched path of travel (in direction of arched arrow in FIG. 1). Because the distance between the centers of indentations 212—212 are one-quarter of the distance between the centers of two adjacent dies, each advancing operation transfers each workpiece one-quarter of the distance between two dies so that in four advancing operations a workpiece will be transferred from a position in front of the center of one die to the front of the center of the next adjacent die. When a workpiece 60 has achieved a position at the center of the front of die 30, 31, 32 a ram (not shown) provided with punches 71 will move forward and punch the workpiece. As the ram retreats, an ejector pin 72 provided at the rear of the said die will travel in the same direction as the ram, thereby ejecting the workpiece from the die into the feeding path where it will come into contact with an indentation 212 of the feeding plate 21 and be transferred one-quarter of the distance to the next adjacent die.

After a workpiece 60 has been advanced to and past all dies and gone through the respective punching operations, it will reach the end of the feed path as a finished product.

When a feeding device of the present invention is used in a nut former in high speed operation, it is desirable to provide a turn-over device for turning over the workpieces 60 to dissipate heat from the workpieces to increase die lifetimes and to insure proper facing on each side of the workpiece. An appropriate turn-over device useable with the feeding device hereof is the subject of a concurrently filed and copending application by the present inventor (Ser. No. 645,078, filed Dec. 29, 1975) and so relevant description is omitted here.

Figure 3:
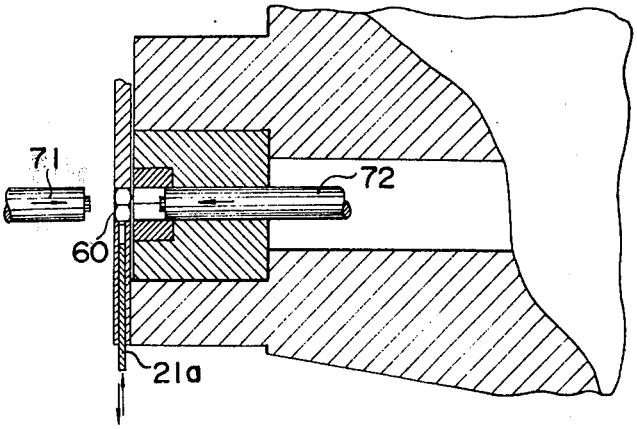
FIGS. 3 & 4 are partial cross sections of two other embodiments according to the present invention.
Figure 4:
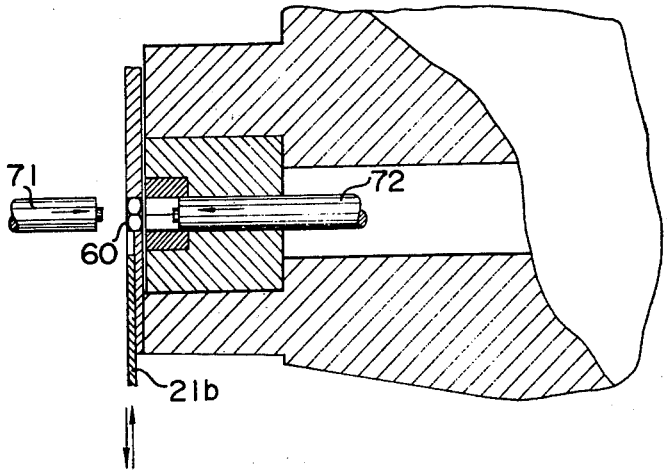

The feeding device according to the present invention may also be implemented with a flat feeding plate as shown in FIGS. 3 and 4. In FIG. 3 feeding plate 21a is inserted into a suitable slot between two faces of the guiding plate. In FIG. 4 feeding plate 21b is provided in a flush position with the guide plate. All other features of these two further embodiments are identical to those previously described with reference to the first embodiment.

The feeding device according to the present invention provides smooth, high speed, intermittent advancement of a workpiece through various work stations while at the same time it is of simple construction making it less subject to malefunctions and wear, thus meeting the requirements for increased high speed production.

What I claim is:

1. A feeding device for a high speed nut forming machine having a machine body on which at least two dies are mounted comprising:

a manipulating mechanism provided on said machine body and adapted to provide advancing motion along a straight line and returning motion along an arched path;

two guide plates provided on said machine body and spaced parallel to one another to define a feeding path between two successive dies, the feeding path having its center axis congruous with a line drawn through and connecting the centers of the two successive dies; and a feeding plate having an edge having a plurality of equally spaced indentations thereon, at least two of said indentations having a suitable shape to hold and convey workpieces positioned in the feeding path between the two parallel guide plates, the distance between a least two of said indentations being a suitable fraction of the distance between the two successive dies, the feeding plate being provided on the manipulating mechanism and adapted to have the edge thereof having the plurality of indentations thereon moveably and removeably positioned in the feeding path;

thereby to successively hold, convey, and release workpieces in said feeding path due to the alternating advancing straight line and returning arched path motions provided by the manipulating mechanism so that workpieces are moved along said feeding path in a plurality of discrete steps from one die to the next successive die.

2. A feeding device according to claim 1 wherein the upper periphery of the feeding plate is inclined toward the machine body.

3. A feeding device according to claim 1 wherein the upper periphery of the feeding plate is coplanar with the body thereof and moves in a flush relationship with one guide plate.

4. A feeding device according to claim 1 wherein the upper periphery of the feeding plate is coplanar with the body thereof and moves in a suitable slot provided in one guide plate.

* * * * *